United States Patent [19]

Adams

[11] 4,178,866

[45] Dec. 18, 1979

[54] ADJUSTABLE BOBBIN THREAD RUN-OUT INDICATOR

[75] Inventor: Kenneth D. Adams, Madison, N.J.

[73] Assignee: The Singer Company, New York, N.Y.

[21] Appl. No.: 916,614

[22] Filed: Jun. 19, 1978

[51] Int. Cl.[2] ..... B65H 63/08; D05B 51/00

[52] U.S. Cl. ..... 112/278; 242/36

[58] Field of Search ..... 112/278, 273; 139/273 A; 242/36; 356/199; 250/560

[56] References Cited

U.S. PATENT DOCUMENTS

| | | | |
|---|---|---|---|
| 1,988,255 | 1/1935 | Soons | 139/273 A |
| 3,082,968 | 3/1963 | Reichelt et al. | 112/278 X |
| 3,599,586 | 8/1971 | Newman | 112/278 |

FOREIGN PATENT DOCUMENTS

| | | | |
|---|---|---|---|
| 405757 | 2/1934 | United Kingdom | 139/273 A |

*Primary Examiner*—Peter P. Nerbun

*Attorney, Agent, or Firm*—Edward P. Schmidt; Robert E. Smith; Edward L. Bell

[57] ABSTRACT

A lock stitch sewing machine having a bobbin thread run-out indicator which is adjustable to permit initiation of the indication with a selected length of bobbin thread remaining on the bobbin. A bobbin case is supported in a rotating loop taker against rotation therewith and partially extending therefrom. The bobbin is fashioned with two flanges joined by a hub and is carried in a cavity in the bobbin case, the cavity being arranged so that one flange of the bobbin also extends partially from the rotating loop taker. A fibre optic is arranged in the sewing machine frame to extend a light ray through an opening in the bobbin case above the rotating loop taker but in between the flanges of the bobbin, adjacent the hub thereof, and through an opening in the opposite side of the bobbin case to a light sensor. The light sensor is carried so as to be sniftable normal to the direction of the light ray. Lateral shift of the light sensor causes the light sensor to receive rays from the fibre optic which are spaced at variable distances from the hub of the bobbin, thereby providing for low thread indication with selected length of bobbin thread remaining on the bobbin hub.

4 Claims, 6 Drawing Figures

Fig. 4
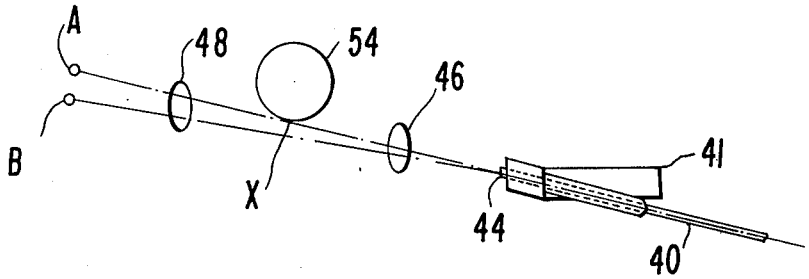
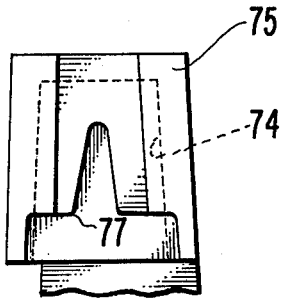
Fig. 5

ADJUSTABLE BOBBIN THREAD RUN-OUT INDICATOR

BACKGROUND OF THE INVENTION

This invention is in the field of sewing machines, more particularly, it pertains to bobbin thread run-out indicators for sewing machines.

Their are in the prior art many forms of bobbin thread run-out indicators. There are for example those devices having bobbins with special cavities into which the thread must be wound initially in order to provide a thread supply remaining after indication of impending depletion, or as part of a means for obtaining an indication of impending depletion. There are also those sewing machines in which bobbin thread run-out indication depends upon reflection of a light source on the empty bobbin hub to a light sensor. Another device as disclosed in the U.S. Pat. No. 3,599,586 of Newman discloses the use of a fibre optic to transfer light from a source to a convex lens which focus the light rays adjacent the hub of the bobbin, which upon depleted thread condition will allow the light rays to pass to another fiber optic for visual perception or to other light sensor.

A problem with these and other bobbin thread run-out indicators is that a more or less high degree of manufacturing accuracy is required in the manufacture of the component parts thereof, and that no capability exists for varying the amount of thread remaining on the bobbin which will initiate the low bobbin indication.

SUMMARY OF THE INVENTION

The above drawbacks are rectified in the applicants invention in which the light sensor or receptor may be repositioned with respect to the light source to correct for manufacturing error or to vary the amount of thread remaining on the bobbin which will initiate the low bobbin indication. A rotating looptaker is provided within which is supported against rotation therewith a bobbin case. The bobbin case extends exteriorly of the rotating looptaker and is fashioned with a cavity within which is supported a bobbin. The bobbin is constructed of two flanges joined by a hub, one flange being situated in that portion of the bobbin case which extends from the rotating looptaker. A fiber optic is supported on the sewing machine frame adjacent the rotating looptaker and transfers light from a source through an opening in that portion of the bobbin case extending from the rotating looptaker. The fiber optic is generally aligned to extend light rays from the end thereof, which comprises a light source, through the opening in the bobbin case to an area adjacent the hub of the bobbin carried within the bobbin case, and through a second opening in the bobbin case to the external portion thereof. A light sensor is supported adjacent the rotating looptaker but on the opposite side thereof from the fiber optic, and in line with both openings in the bobbin case. An adjustable arrangement is provided for supporting the light sensor which permits the position of the light sensor to be varied in a plane that shifts the axis of the light rays from the fiber optic to the light sensor closer or farther away from the hub of the bobbin carried in the bobbin case. The preferred arrangement for the specific bed casting in which the invention is placed supports the light sensor in one end of the first leg of a centrally pivoted lever, the first and second legs of which extends from the pivot point in an acute angle. The axis of the first leg and light sensor is substantially coincident with the openings in the bobbin case and the fiber optic. The second leg of the centrally pivoted lever carries a screw transverse thereof, which screw impinges on a rib of the casting. A spring bias is provided to urge the screw in the second lever into constant engagement with the rib of the casting. Rotation of the screw in one direction or the other will change the position of the centrally pivoted lever and of the light sensor in one end of the first leg thereof and will shift the line between the fiber optic and the light sensor from a position coincident with the hub of the bobbin carried in the bobbin case to a position spaced therefrom. Electronic circuitry is provided for detecting the incidence of light on the light sensor which takes place when the amount of thread supported on the hub of the bobbin is less than that required to shield the light sensor from the light from the fiber optic.

DESCRIPTION OF THE DRAWINGS

For a better understanding of the invention, reference may be added to the specification and the drawings in which:

FIG. 4 is a diagram related to FIG. 2 and showing the variability in initiation of the bobbin thread indication possible by shifting the light sensor;

FIG. 5 is a frontal view of the sensor housing taken substantially along line 5—5 of FIG. 3; and, FIG. 6 is a block diagram of the electronics for implementing the bobbin thread low indication.

DESCRIPTION OF THE PREFERRED EMBODIMENT

Figure 1:
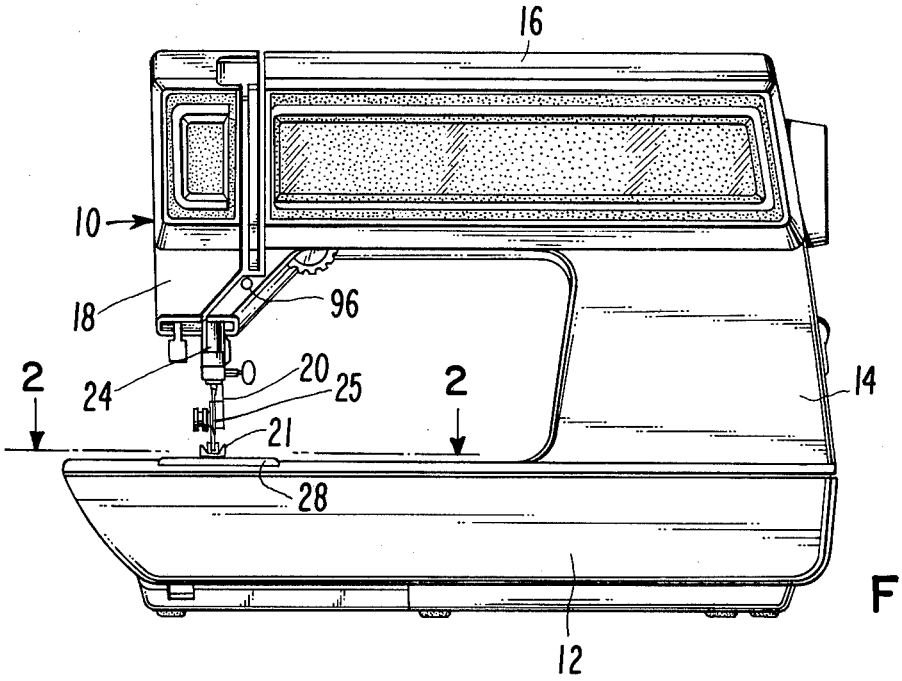
FIG. 1 is a front elevational view of a sewing machine in which the invention may be incorporated.

Referring now to the drawings there is shown in FIG. 1 a sewing machine 10 to which the invention may be applied. The frame portion of the sewing machine 10 includes a bed 12 from one end of which rises a standard 14. The standard 14 supports an arm 16 in overhanging relationship to the bed 12, the arm terminating in a head portion 18. Within the head portion 18 there is supported in the usual fashion for sewing machines a presser bar 20 terminating in a presser foot 21 for urging work material against feed dogs (not shown) in the bed 12 of the sewing machine. Also supported in the head portion 18 for endwise reciprocation as is well known in the sewing machine art is a needle bar 24 terminating in a sewing needle 25, in such a fashion that the sewing needle will cooperate with a rotating looptaker 30 (see FIG. 2) supported in the bed 12. Not shown in FIG. 1 is the feed system and feed dogs supported in the bed 12 which, intermittent to penetration of the work material by the sewing needle 25, urges the work material in a selected direction forward or reverse. Also not shown is the actuating means for causing endwise reciprocation of the needle bar 24, and for causing rotation of the looptaker 30 as well as driving the feed system. There is apparent in FIG. 1 the bed slide 28 which normally covers the rotating looptaker 30 while providing support for the work material.

Figure 2:
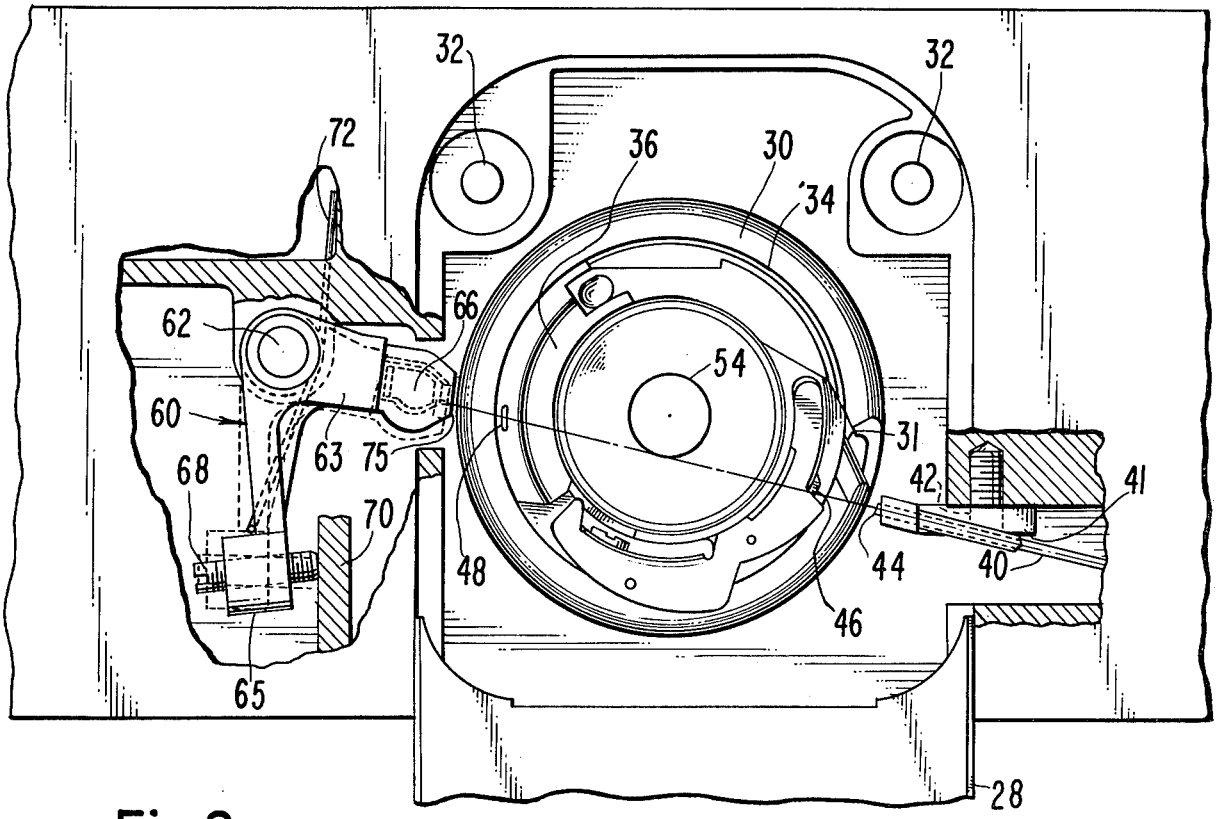
FIG. 2 is a view taken substantially along line 2—2 of FIG. 1 showing a view in plan of a portion of the bed, partially broken away, in which certain components thereof have been removed in order to show detail.

Referring now to FIG. 2 there is shown in plan that portion of the bed 12 within which is supported the rotating looptaker 30. The bed slide 28 has been slid out of the way to expose the rotating looptaker 30 to view, and the throat plate (not shown) normally retained by magnets 32 has also been removed. Portions of the bed 12 have also been broken away so that the invention may be seen in greater detail. The rotating looptaker 30 is somewhat cup-shaped with the uppermost edge formed inwardly so that a slot therethrough will form a hook point 31. The uppermost edge of the rotary looptaker 30 is formed with a rabbet 34 so as to provide support for the extended ledge of a bobbin case 36 (see FIG. 3). As may be apparent from an inspection of FIG. 3 the bobbin case 36 is carried primarily within the rotating looptaker 30, but there is a portion which extends therefrom. The upper surface of the bobbin case 36 supports thereon thread handling components to provide bobbin thread tension and thread guidance. For more information on this specific form of rotating looptaker, bobbin case and bobbin arrangement disclosed herein the reader is referred to U.S. Pat. No. 3,693,566, issued on Sept. 26, 1972 to S. J. Ketterer, which is assigned to the same assignee as the instant application, and is hereby incorporated by reference herein.

Figure 3:
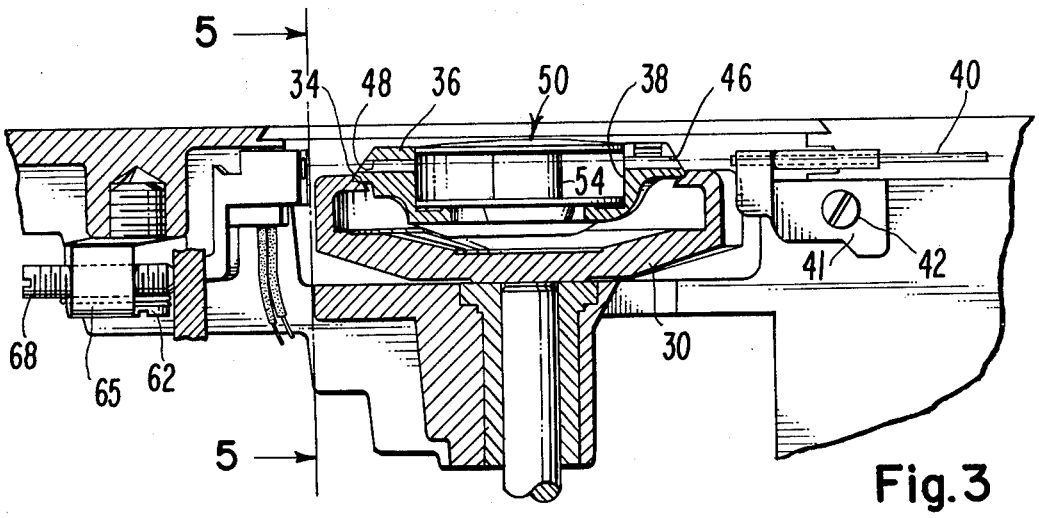
FIG. 3 is a cross sectional view taken substantially along line 3—3 of FIG. 2 showing in greater detail the bobbin thread run out arrangement of this invention.

Referring to FIGS. 2 and 3 there is shown a fiber optic 40 held by a support 41 which is attached to the sewing machine frame by screw 42. Light from a light source (not shown) is picked up by the fiber optic 40 and transferred by the fiber optic to the end 44 thereof, which end then operates as a light source itself. That portion of the bobbin case 36 extending from the rotating looptaker 30 is fashioned with openings 46, 48 in substantial alignment with the fiber optic 40. The bobbin case 36 is fashioned with a cavity 38, which cavity receives a bobbin 50 having an upper and lower flanges 52 joined by a hub 54. The fiber optic 40 and openings 46, 48 in the bobbin case 36 are situated with respect to each other and to the bobbin 50 so as to be substantially tangential to the hub 54 of the bobbin.

Arranged in the bed 12 of the sewing machine 10 on that side of the rotating hook 30 opposite the fiber optic 40 there is a bent lever 60. The bent lever 60 is supported in the bed 12 of the sewing machine 10 on a shoulder screw 62 extending through the bent lever at the bend thereof and fastened to the sewing machine frame. The first leg 63 of the bent lever 60 extends from the pivot screw 62 to the rotating looptaker 30 and carries in the end thereof, in substantial alignment with the axis of the first lever, a light sensor 66. A light ray transmitted from the end 44 of the fiber optic 40 will pass through the openings 46, 48 in the bobbin case 36 to the light sensor 66 supported in the end of the first leg 63 of the bent lever 60. The second leg 64 of the bent lever 60 also extends from the pivot screw 62, and is fashioned at the end thereof with a boss 65 which is threaded to accept an adjusting screw 68 substantially transverse to the second leg. The adjusting screw 68 impinges upon a rib 70 of the bed 12. A biasing spring 72 urges the bent lever 60 in a direction to maintain the adjusting screw 68 in constant contact with the rib 70 of the bed 12.

Referring to FIG. 4, the effect of rotation of the bent lever 60 around the pivot screw 62 by means of the adjusting screw 68 may be demonstrated. The letters A and B represent the two extreme positions of the active area of the light sensor 66 achieved by turning screw 68 from one extreme position to the other. As explained above the fiber optic 40 has an end 44 thereof which operates as a light source. Light rays from the end 44 of the fiber optic 40 extend through the openings 46, 48 in the bobbin case 36, which openings are oval in shape to accommodate the adjustment capability contemplated. Where the light sensor 66 is positioned by the screw 68 so that its active area is located in the position A shown in FIG. 4 is easy to see from the position of the light ray with respect to the hub 54 of the bobbin that no thread may remain on the hub without impeding the passage of the light ray to the sensor which is necessary for initiation of a low bobbin indication. If however the sensor 66 is positioned so that its active area is located as shown at B in FIG. 4 it will be understood that an indication of a low bobbin thread condition will not be initiated until there is less than "X" thickness of bobbin thread on the hub 54 of the bobbin 50, which would allow light to pass. Adjustment for a low bobbin indication with a thread supply on the hub 54 of less than "X" thickness may be accommodated by rotation of the adjusting screw 68 to position the active area of light sensor 66 somewhere between the positions A and B shown in FIG. 4.

Referring to FIG. 5 there is shown a frontal elevation of the first leg 63 of the bent lever 60, in order to indicate how the light sensor 66 may be shielded from ambient light in order to increase the sensitivity thereof. By referring to FIG. 2, it may be noted that the light sensor 66 is spaced from the end 75 of the first leg 63. By referring to FIG. 5, it will be noted that the end face 75 of the first leg 63 of the bent lever 60 is fashioned with an upwardly tapering opening 77 which extends from the end face to the cavity 79 receiving the light sensor 66. This form of construction provides an arrangement to shield the light sensor 66 from any external light which may, for example, pass through a bobbin inspection window (not shown) in the bed slide 28.

Figure 6:
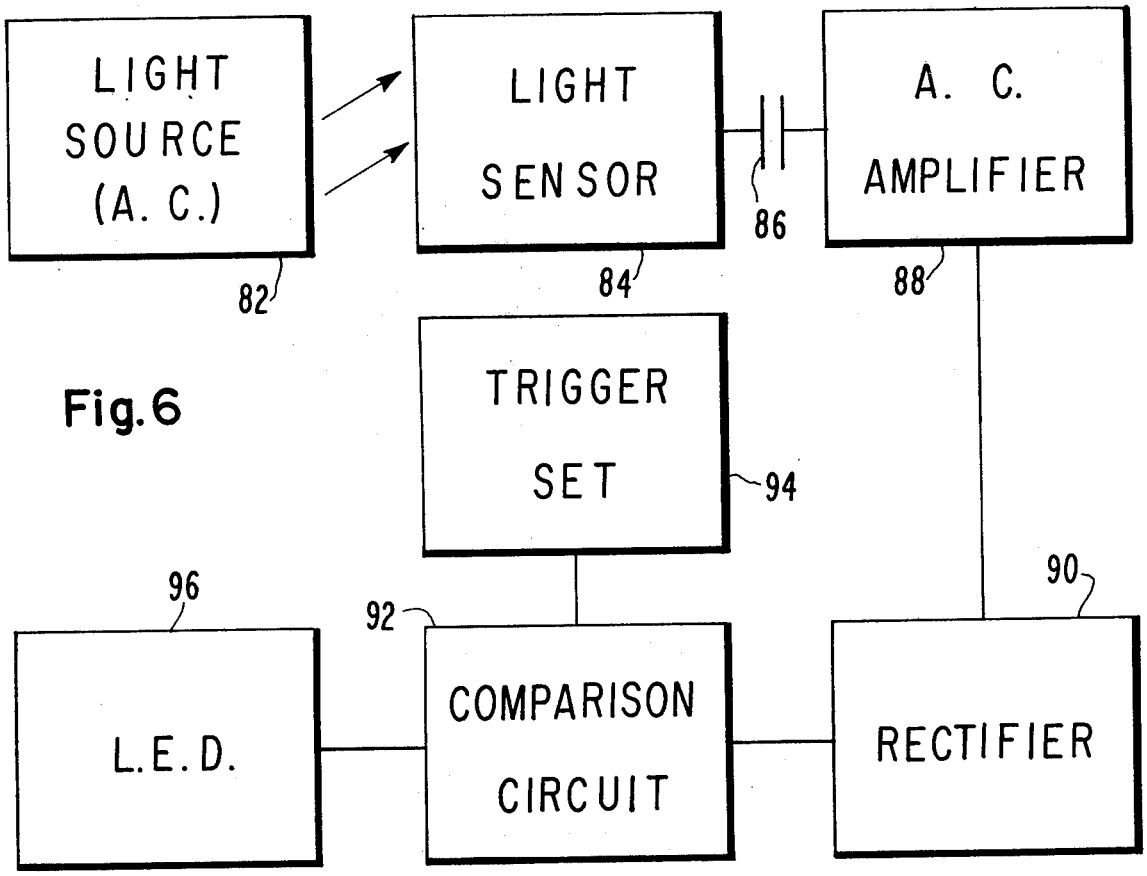

Referring to FIG. 6, there is shown a block diagram of the circuit implementing the low bobbin indication. There is provided a light source 82 operating from an AC source, or more preferably, from a pulsating DC source obtained by half wave rectification of an AC source. A light sensor 84 is provided which may be implemented by a Photo Darlington, for example. The output from the light sensor 84 passes through a capacitance 86 which is provided to block the DC output from the light sensor 84 implemented by a Photo Darlington in order to eliminate dark currents as a source of low bobbin signal. Thus the light sensor 84 responds to the variation in the light source 82 caused by the pulsating DC source. The resulting alternating current passed by the capacitance 86 is amplified in an AC amplifier 88. After amplification the AC current is rectified in rectifier 90 and the resulting signal is compared by a comparison circuit 92 to a value adjusted by trigger set 94. The comparison circuit 92 includes therein, ideally, an operational amplifier having positive feedback in order to latch a valid indication once achieved into a permanent signal. The output on the comparison circuit 92 is then fed to a LED 96 which is visible to the eye of the operator and may be seen in FIG. 1. The indication may be implemented preferably by a blinking light from the LED 96, which is thereby more apparent to an operator.

Having thus set forth the nature of the invention, what is sought to be claimed is:

1. A lockstitch sewing machine having a frame, said frame supporting sewing instrumentalities including a needle carrying needle bar supported by said frame for endwise reciprocation, a feed system for urging work material in a path under said needle, a looptaker supported in said frame for cooperation with said needle in the formation of stitches, and a bobbin case supported by said looptaker, said bobbin case supporting therein a bobbin having a pair of flanges separated by a thread carrying hub; wherein the improvement comprises; an adjustable bobbin thread run-out indicator including a light source, means for extending light rays from said light source adjacent said hub of said bobbin between said flanges thereof, means on the opposite side of said bobbin case and looptaker from said extending means for sensing the presence of a light ray, and, means for supporting said sensing means for selective movement in a direction substantially normal to said light rays.

2. A lockstitch sewing machine as claimed in claim 1 wherein said extending means includes a fiber optic for transferring light from the light source to an opening in one side of said bobbin case situated between the flanges of said bobbin and extending substantially tangentially to the hub thereof to a second opening in the opposite side of said bobbin case, and wherein said sensing means is in substantial alignment with said openings in said bobbin case.

3. A lockstitch sewing machine as claimed in claim 2 wherein at least one of said openings in said bobbin case is substantially eliptical in shape with the major axis of the ellipse lying in a plane extending normal to the hub of the bobbin.

4. A lockstitch sewing machine as claimed in claim 1 wherein said supporting means for said sensing means includes a bent lever, said bent lever being pivoted to said sewing machine frame at the bend thereof and having a first arm supporting said sensing means in the end thereof and arranged in a fashion to receive said light rays from said extending means, and a second arm extending from said bend adjacent a portion of said sewing machine frame; and means for selectively spacing said second arm from said sewing machine frame whereby said sensing means in said end of said first arm is responsive to light rays of selectively variable distance from said hub of said bobbin in order to give an indication of thread supply on said thread carrying hub of less than said selectively variable distance.

* * * * *